US009392858B2

(12) United States Patent
Tani

(10) Patent No.: US 9,392,858 B2
(45) Date of Patent: Jul. 19, 2016

(54) COSMETIC MATERIAL APPLYING CONTAINER

(71) Applicant: TOKIWA CORPORATION, Gifu (JP)

(72) Inventor: Yoshikazu Tani, Kawaguchi (JP)

(73) Assignee: TOKIWA CORPORATION, Gifu (JP)

( * ) Notice: Subject to any disclaimer, the term of this patent is extended or adjusted under 35 U.S.C. 154(b) by 247 days.

(21) Appl. No.: 13/972,182

(22) Filed: Aug. 21, 2013

(65) Prior Publication Data

US 2014/0064822 A1 Mar. 6, 2014

(51) Int. Cl.
*A45D 40/26* (2006.01)

(52) U.S. Cl.
CPC ..... *A45D 40/26* (2013.01); *A45D 2200/055* (2013.01); *A45D 2200/1072* (2013.01)

(58) Field of Classification Search
CPC ... A45D 34/04; A45D 40/26; A45D 2200/10; B05C 17/00516; B05C 35/36; B05C 35/38
USPC ..... 401/265; D28/7
See application file for complete search history.

(56) References Cited

U.S. PATENT DOCUMENTS 2,442,503 A * 6/1948 Melnikoff ..... 401/175
2012/0076568 A1* 3/2012 Tani ..... 401/266

FOREIGN PATENT DOCUMENTS

JP 2008-212214 9/2008
JP 2012/085964 5/2012

* cited by examiner

*Primary Examiner* — Mark A Laurenzi
*Assistant Examiner* — Bradley Oliver
(74) *Attorney, Agent, or Firm* — Greenblum & Bernstein, P.L.C.

(57) ABSTRACT

The present invention provides a cosmetic material applying container that provides comfortable use feeling and facilitates drawing a narrow line. A cosmetic material applying container includes a leading end portion which discharges a cosmetic material and is formed of a soft material. The leading end portion has a flat shape and an edge shape. A top end surface of the leading end portion constitutes an applying surface, and the leading end portion has a tapered shape. The distal end side of the leading end portion is formed in a sharp shape. The applying surface includes a distal end where a vertex position constitutes a sharp portion. The applying surface includes a concave part depressed toward a base end side in a side view at the distal end side.

2 Claims, 13 Drawing Sheets

COSMETIC MATERIAL APPLYING CONTAINER

TECHNICAL FIELD

The present invention relates to a cosmetic material applying container that discharges cosmetic material from a leading end portion of the cosmetic material applying container.

BACKGROUND ART

A known conventional cosmetic material applying container discharges cosmetic material filled in a filling region inside of the container from a leading end portion formed of soft material as described in, for example, Patent Document 1. In this cosmetic material applying container, the leading end portion is formed to have an outer shape of a transverse cross section in a flat shape and an edge shape in a side view. The leading end portion includes a top end surface that constitutes an applying surface. The applying surface includes a distal end where a vertex position is formed.

CITATION LIST

Patent Literature

Patent Document 1: Japanese Unexamined Patent Application Publication No. 2012-85964

SUMMARY OF THE INVENTION

Problems to be Solved by the Invention

Here, the recent cosmetic material applying container requires further improvement in use feeling so as to obtain comfortable use feeling. As the above-described cosmetic material applying container, for example, ease of drawing a narrow line may be desired while diversification of needs in makeup progresses.

Consequently, an object of the present invention is to provide a cosmetic material applying container that provides comfortable use feeling and facilitates drawing a narrow line.

Solutions to the Problems

In order to solve aforementioned disadvantage, the cosmetic material applying container of the present invention includes a leading end portion for discharging a cosmetic material filled in a filling region inside of the container. The leading end portion is formed of a soft material, and the leading end portion has an outer shape of a transverse cross section in a flat shape and an edge shape in a side view along a shorter axis direction. A top end surface of the leading end portion constitutes an applying surface. The leading end portion has a tapered shape with a shorter length of the shorter axis toward a distal end side, the distal end side of the leading end portion is formed in a sharp shape where one side in a longer axis direction is sharpened at an acute angle viewed from the distal end side, the applying surface includes a distal end where a vertex position is formed, the vertex position constitutes a sharp portion of the distal end of the leading end portion, and the applying surface includes a concave part at the distal end side, the concave part is depressed toward a base end side in a side view.

The cosmetic material applying container has the concave part at the distal end side of the applying surface. The concave part is depressed toward the base end side in a side view. This reduces contact between the applying surface and the skin during usage, and reduces contact feeling by the applying surface so as to obtain comfortable use feeling. In addition, the concave part ensures a thin distal end side of the leading end portion. This facilitates drawing a narrow line. The thin distal end side of the leading end portion ensures a flexible (soft) distal end side with good contact feeling, that is, adds flexibility to the distal end side, thus further ensuring comfortable use feeling.

According to the preferable configuration, the applying surface includes a convex part that bulges toward the distal end side in the side view at the base end side of the concave part. In this case, cosmetic material is discharged from the more distal end side of the leading end portion. Accordingly, the cosmetic material applying container is easily used in an upright position on the skin.

According to the preferable configuration, the applying surface has a curved surface shape that extends in an S-shape in the side view by smoothly connecting the concave part and the convex part each other According to the preferable configuration, the shape of the leading end portion is three-dimensionally formed by constituting a flat column body by a flat base end shape and a flat distal end shape, the distal end shape being disposed at a distal end side with respect to the base end shape, setting a curved line on a planar surface that includes a longer axis of the base end shape and a longer axis of the distal end shape in the column body, the curved line being inclined from one intersecting point between an outer edge of the distal end shape and the longer axis of the distal end shape toward the base end side, the curved line having a depressed shape at the distal end side, the depressed shape being depressed toward the base end side and cutting the column body with a cut surface passing through the curved line. In this case, this allows appropriately three-dimensionally forming the applying surface that has the concave part at the distal end side. The concave part is depressed toward the base end side in a side view.

Advantageous Effects of the Invention

The present invention provides comfortable use feeling and facilitates drawing a narrow line.

DESCRIPTION OF EMBODIMENTS

Figure 1:
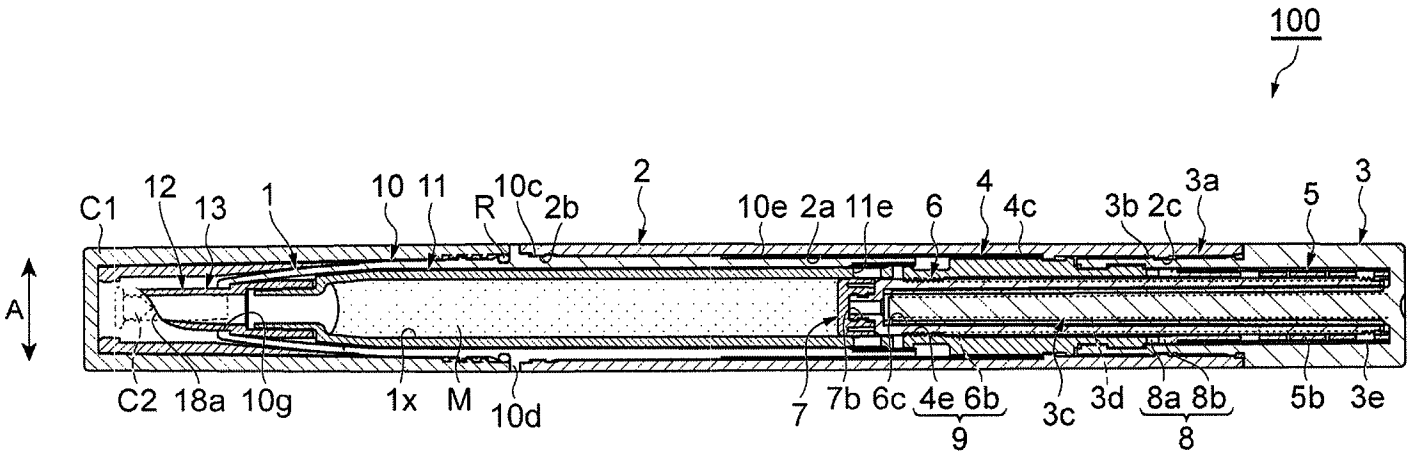
FIG. 1 is a longitudinal cross sectional view showing a cosmetic material applying container according to one embodiment of the present invention.

An embodiment according to the present invention will be described below with reference to the accompanying drawings. The same reference numerals are attached to the same or corresponding elements in the following description, and an overlapping description will be omitted.

Figure 2:
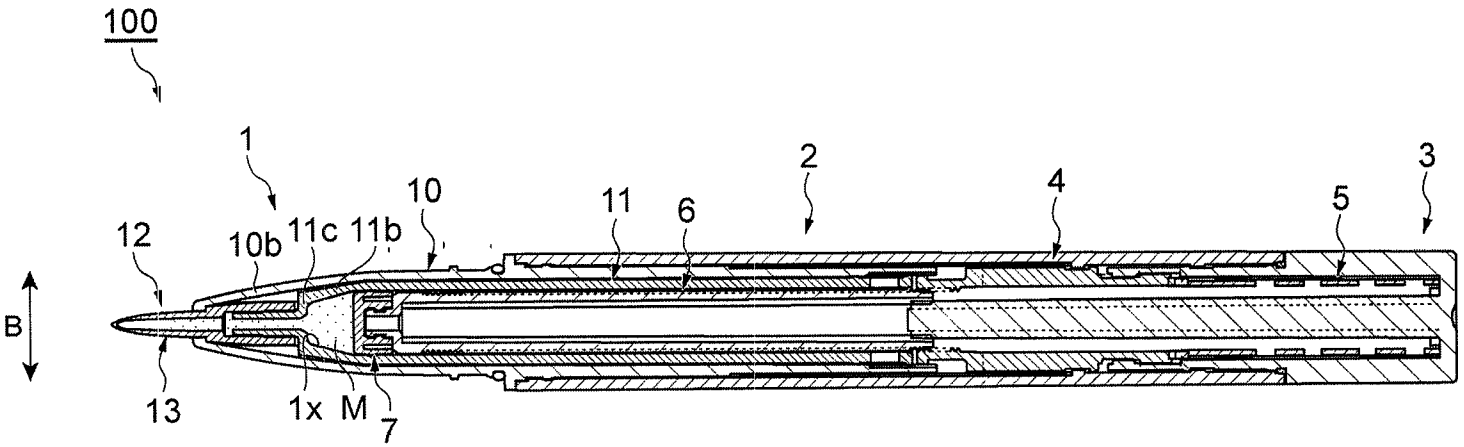
FIG. 2 is a longitudinal cross sectional view showing a movable body at the forward limit in the cosmetic material applying container in a vertical cross sectional position different from the vertical cross sectional position of FIG. 1 by 90°.
Figure 3:
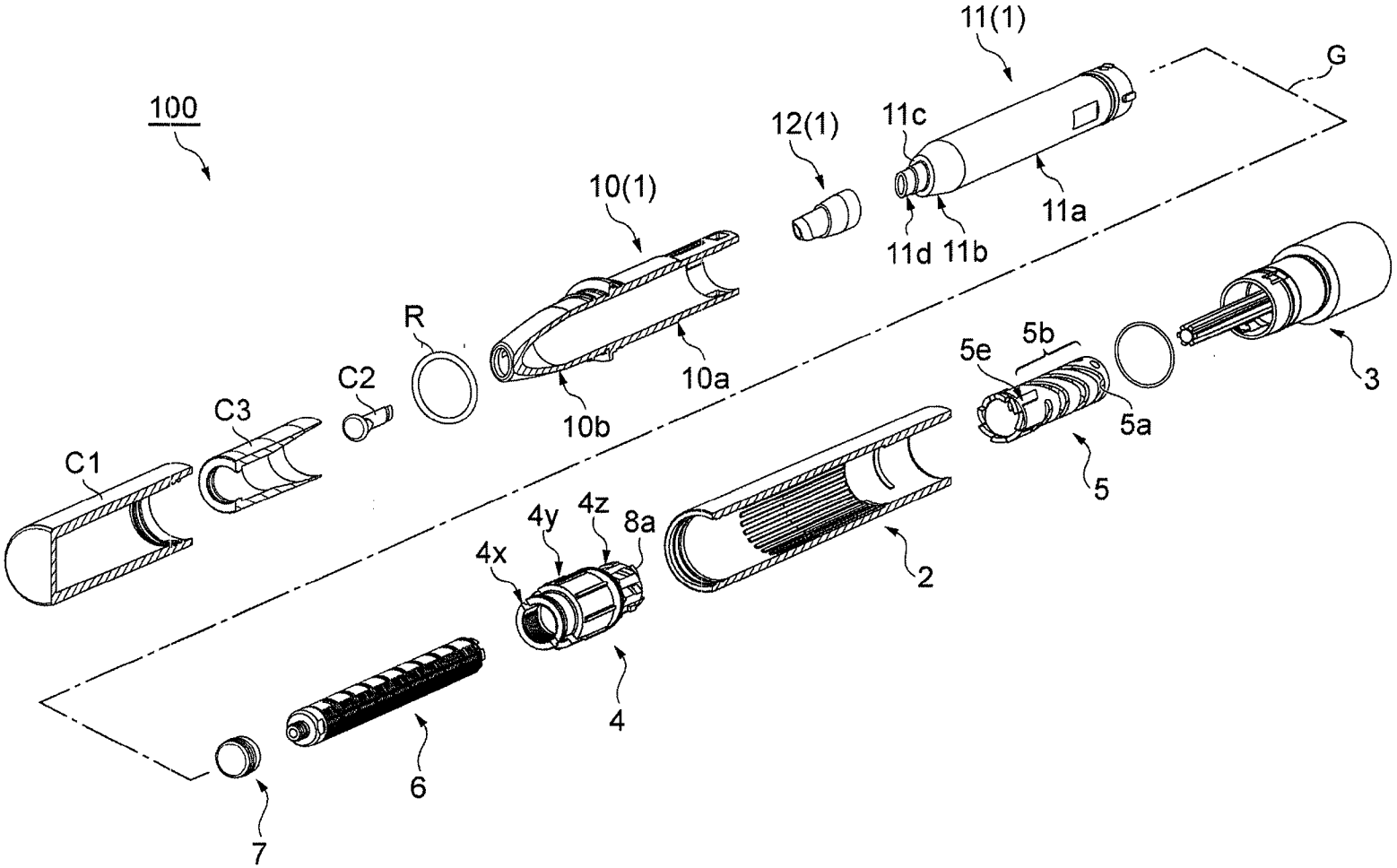
FIG. 3 is an exploded perspective view showing a partial cross section of the cosmetic material applying container of FIG. 1.
Figure 4:
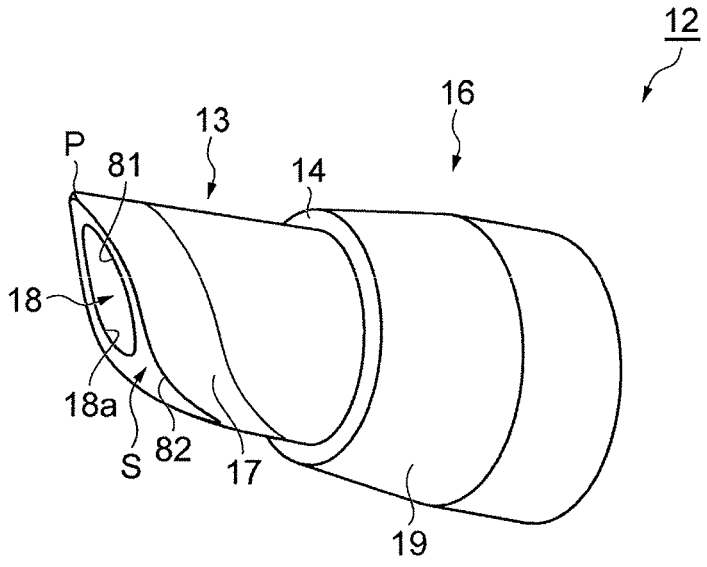
FIG. 4 is a perspective view showing a leading end member in the cosmetic material applying container of FIG. 1.

FIG. 1 is a longitudinal cross sectional view showing a cosmetic material applying container according to one embodiment of the present invention. FIG. 2 is a longitudinal cross sectional view showing a movable body at the forward limit in the cosmetic material applying container in a vertical cross sectional position different from the vertical cross sectional position of FIG. 1 by 90°. FIG. 3 is an exploded perspective view showing a partial cross section of the cosmetic material applying container of FIG. 1. As shown in FIG. 1, a cosmetic material applying container 100 according to the present embodiment arbitrarily discharges (extrudes) a cosmetic material M filled in an inner portion of the cosmetic material applying container 100 by an operation of a user.

As this cosmetic material M, for example, it is possible to employ various cosmetic materials such as an eye liner, an eyebrow, a lip liner, an eye shadow, a body paint, an enamel, a lip gloss, an eye color, a cheek color, a concealer, and a hair color. It is particularly suitable to employ a very soft material (a gel state, a semisolid state, a soft solid state, a soft state, a jelly state, a moose state, a paste state including them and the like). Further, it is possible to enhance a long lasting characteristic by blending a volatile solvent (for example, a silicon oil such as a cyclopentasiloxane or the like, and a hydrocarbon oil such as an isododecane and an isohexadecane) in addition to a pigment, a cosmetic material oil solution, a wax or the like, as the cosmetic material M.

Further, the cosmetic material M can employ a material from a low viscosity to a high viscosity, and particularly preferably employs the cosmetic material M having a hardness between about 0.1 N and 0.3 N. The hardness of the cosmetic material M is determined in accordance with a general measuring method which is used for measuring a hardness in a cosmetic. In this case, a hardness (a penetration number) is set to a force (a strength) at a peak time generated in the cosmetic material M in the case of using, for example, FUDOH RHEO METER [RTC-2002D.D] (manufactured by LEOTECH company) as a measuring device, and inserting a steel bar of ϕ3 mm to the cosmetic material M at a speed of 6 cm/min by a depth of about 10 mm under a condition of an ambient temperature of 25° C.

As shown in FIGS. 1 to 3, the cosmetic material applying container 100 includes a filling member 1, a main body cylinder 2, and a control cylinder 3, as an outer structure. The filling member 1 is a leading tube that includes a filling region 1*x* filled with the cosmetic material M in an inner portion of the filling member 1. The main body cylinder 2 allows inward insertion of a rear half portion of the filling member 1 into a front half portion of the main body cylinder 2 to engage and integrally couple to the filling member 1 in an axial direction (a back and forth direction) and a rotating direction around an axis (hereinafter, referred simply to as "a rotating direction"). The control cylinder 3 is coupled to a rear end portion of the main body cylinder 2 in the axial direction to relatively rotate. In this case, "axis" means a center line extending to back and forth sides of the cosmetic material applying container 100 ("axis" described hereinafter has the same meaning).

The cosmetic material applying container 100 schematically includes a movable body 6, a piston 7, a screw cylinder 4, and a ratchet member 5 in its inner portion. The movable body 6 moves in the axial direction by relative rotation between the main body cylinder 2 (or the filling member 1) and the control cylinder 3. The piston 7 as an extruding portion is mounted on a front end (distal end) portion of the movable body 6 to constitute (form) a rear end of the filling region 1*x*. The screw cylinder 4 as a thread engagement portion allows moving the movable body 6 by the relative rotation. The ratchet member 5 can rotate relative to the screw cylinder 4 only in one direction. Further, the cosmetic material applying container 100 includes a ratchet mechanism 8. The ratchet mechanism 8 allows relative rotation between the main body cylinder 2 and the control cylinder 3 only in one direction.

The main body cylinder 2 is constituted in a cylindrical shape. The main body cylinder 2 includes a knurling 2*a* in an inner peripheral surface of the center portion in the axial direction. In the knurling 2*a*, a lot of concavo-convex shapes are arranged side by side in a peripheral direction to engage the filling member 1 and the screw cylinder 4 with each other in the rotating direction. The concavo-convex shapes extend at a predetermined length in an axial direction. A tip end of the main body cylinder 2 includes an inner peripheral surface where an annular protrusion 2*b* is disposed to engage the filling member 1 in the axial direction. The main body cylinder 2 includes, at its rear portion side, an inner peripheral surface where a protrusion 2*c* is formed to extend along the peripheral direction to engage the control cylinder 3 in the axial direction.

The control cylinder 3 is an injection molded product made of resin, and has a closed-bottomed cylindrical shape that is opened forward. The control cylinder 3 includes, at its front end side, a front end tube portion 3*a* that has a small outer diameter. The front end tube portion 3*a* includes an outer peripheral surface where an annular groove portion 3*b* is disposed to engage the protrusion 2*c* of the main body cylinder 2 in the axial direction. In the control cylinder 3, a shaft body 3*c* is disposed upright at the center of the bottom portion. The shaft body 3*c* includes a plurality of projections 3*d* that extend in the axial direction on an outer peripheral surface of a cylindrical body, and has a noncircular shape in a transverse cross section (a cross section perpendicular to the axial direction). The projection 3*d* constitutes one of a rotation preventing portion of the movable body 6.

The control cylinder 3 includes, on its inner peripheral surface, a projection 3*e* that extends from the bottom portion toward a distal end side. The projections 3*e* are disposed at eight uniformly arranged positions in a peripheral direction. The control cylinder 3 is inward inserted to the main body cylinder 2 from the front end tube portion 3*a*. Subsequently, the annular groove portion 3*b* engages the protrusion 2*c* of the main body cylinder 2 so as to be coupled and mounted to rotate relative to the main body cylinder 2 in the axial direction.

The screw cylinder 4 is an injection molded product made of resin, and has an outer shape in a stepped cylindrical shape. The screw cylinder 4 includes a front end tube portion 4*x*, a center tube portion 4*y*, and a rear end tube portion 4*z* in this order from forward to rearward. The center tube portion 4*y* has an outer shape with a larger diameter than a diameter of the front end tube portion 4*x*. The rear end tube portion 4*z* has an outer shape with a smaller diameter than a diameter of the center tube portion 4*y*. On the other hand, the screw cylinder 4 has an inner peripheral surface that extends straight along the axial direction without any step.

The front end tube portion 4*x* constitutes a front end of the screw cylinder 4. The front end tube portion 4*x* includes an inner peripheral surface where a female thread 4*e* is disposed. The female thread 4*e* constitutes one of a thread engagement portion (the extruding mechanism) 9. The center tube portion 4*y* constitutes the central portion of the screw cylinder 4 and a portion close to the front end of the central portion. The center tube portion 4*y* includes an outer peripheral surface where projections 4*c* are formed in a plurality of positions in a peripheral direction to engage the knurling 2*a* of the main body cylinder 2 in the rotating direction.

The rear end tube portion 4*z* includes a rear end portion of the screw cylinder 4 and a portion close to the rear end of the central portion. The rear end tube portion 4*z* includes a rear end surface where a plurality of ratchet teeth 8*a* are disposed along a peripheral direction. The ratchet teeth 8*a* engage the ratchet member 5, as a constituent of the ratchet mechanism 8. Here, the ratchet teeth 8*a* are disposed at four uniformly arranged positions in the peripheral direction to protrude on the rear end surface.

The screw cylinder 4 is inward inserted to the main body cylinder 2. The projection 4*c* of the screw cylinder 4 engages the knurling 2*a* of the main body cylinder 2 in the rotating direction. The rear end tube portion 4*z* of the screw cylinder 4 is inward inserted to the control cylinder 3. Accordingly, the screw cylinder 4 is mounted to engage the main body cylinder 2 in the rotating direction so as to rotate synchronously with the main body cylinder 2.

The ratchet member 5 is an injection molded product made of resin, and has an approximately cylindrical shape. The ratchet member 5 includes a front end surface where a plurality of ratchet teeth 8*b* are disposed along a peripheral direction as a constituent of the ratchet mechanism 8. The ratchet teeth 8*b* engage the ratchet teeth 8*a* of the screw cylinder 4. Here, the ratchet teeth 8*b* are disposed at eight uniformly arranged positions in the peripheral direction to protrude on the front end surface of the ratchet member 5.

The ratchet member 5 includes a peripheral wall where an approximately spiral slit 5*a* is formed in a portion from the center to the rear end. Accordingly, the ratchet member 5 has a function of a spring portion 5*b* that biases the ratchet teeth 8*b* forward to the ratchet teeth 8*a* side. The ratchet member 5 includes an outer peripheral surface where a longitudinal rib 5*e* is disposed in a front end of the outer peripheral surface to engage the projection 3*e* of the control cylinder 3 in the rotating direction. The longitudinal rib 5*e* has a predetermined width in a peripheral direction, and extends in an axial direction. The longitudinal ribs 5*e* are disposed at eight uniformly arranged positions in the peripheral direction in the front end on the outer peripheral surface of the ratchet member 5.

The ratchet member 5 is inward inserted to the control cylinder 3 from the rear side. Subsequently, the longitudinal rib 5*e* enters to an area between the projections 3*e* and 3*e* of the control cylinder 3 so as to engage the longitudinal rib 5*e* with the projection 3*e* in the rotating direction. Along with this engagement, the ratchet member 5 reaches the rear end side of the screw cylinder 4 so as to allow engaging the ratchet teeth 8*b* with the ratchet teeth 8*a* of the screw cylinder 4. Accordingly, the ratchet member 5 is assembled in the control cylinder 3 in a rotation restricted state to allow rotation relative to the screw cylinder 4 in only one rotating direction using the ratchet teeth 8*a* and 8*b*.

The ratchet member 5 is sandwiched between the rear end side of the screw cylinder 4 and the bottom surface of the control cylinder 3 in the axial direction. This generates a biasing force (an elastic force) by the spring portion 5*b* so as to bias the ratchet teeth 8*b* forward. Subsequently, the ratchet teeth 8*a* and 8*b* engaged with one another become in a click engagement state.

The movable body 6 has a cylindrical shape, and includes a male thread 6*b* that constitutes the other of the thread engagement portion 9 on an outer peripheral surface from a rear side of the front end to the rear end portion. The movable body 6 includes an inner peripheral surface where projections 6*c* are disposed at six uniformly arranged positions along a peripheral direction. The projection 6*c* constitutes the other of the rotation preventing portion of the movable body 6 to inwardly project in the radial direction and extend in the axial direction. The movable body 6 is outward inserted to the shaft body 3*c* of the control cylinder 3, and inward inserted to the screw cylinder 4. The male thread 6*b* is threadably mounted on the female thread 4*e* of the screw cylinder 4. The projection 6*c* of the movable body 6 is mounted by engagement between the projections 3*d* and 3*d* (see FIG. 1) of the shaft body 3*c* so as to engage the control cylinder 3 in the rotating direction to be movable in the axial direction.

The piston 7 is formed by a polyester elastomer (TPEE), a polyurethane elastomer (TPU), a polypropylene (PP), a high-density polyethylene (HDPE), a linear low-density polyethylene (LLDPE) or the like that have a different color tone (for example, a white color) from a color tone of the cosmetic material M. The piston 7 is formed with an outer shape in an approximately columnar shape. The front end surface of the piston 7 forms a planar shape perpendicular to the axial direction, and the rear end surface of the piston 7 includes a concave part. That is, the piston 7 includes a flat front surface, and has a U shape that is opened rearward in a longitudinal cross sectional view. The concave part includes an inner peripheral surface where an annular protrusion 7*b* is disposed to engage the movable body 6 to be movable by a predetermined length in the axial direction.

The piston 7 is outward inserted to the front end of the movable body 6. The annular protrusion 7*b* engages the movable body 6 in the axial direction. This mounts the piston 7 on the movable body 6 to be movable (movable within a predetermined range) in the axial direction.

The filling member 1 is formed of, for example, an injection molded plastic such as a polyethylene terephthalate (PET), a polybutylene terephthalate (PBT), a poly cyclohexane dimethylene terephthalate (PCTA), and a polypropylene (PP) that are excellent in permeability resistance to volatile solvent. The filling member 1 includes an outer filling cylinder 10, an inner filling cylinder 11, and a leading end member 12. The outer filling cylinder 10 constitutes an outer periphery. The inner filling cylinder 11 demarcates the filling region 1*x* inside of the outer filling cylinder 10. The leading end member 12 constitutes a tip end of the filling member 1 to apply the cosmetic material M.

The outer filling cylinder 10 is formed of a colored material (for example, a black color). The outer filling cylinder 10 includes a main body 10*a* in a cylindrical shape and a tapered part 10*b* that connects to a front side of the main body 10*a*. The main body 10*a* includes an outer peripheral surface where an annular concave part 10*c* is disposed at the center in the axial direction. The annular concave part 10*c* engages the annular protrusion 2*b* of the main body cylinder 2 in the axial direction. The main body 10*a* includes an annular collar portion 10*d* at a front side of the annular concave part 10*c* on the outer peripheral surface. The collar portion 10*d* is brought into contact with a front end surface of the main body cylinder 2. The main body 10*a* includes a knurling 10*e* at a rear end portion of the outer peripheral surface. In the knurling 10*e*, a lot of concavo-convex shapes are arranged side by side in a peripheral direction to engage the knurling 2*a* of the main body cylinder 2 in the rotating direction. The concavo-convex shapes extend at a predetermined length in the axial direction.

The tapered part 10*b* has a tapered truncated-cone tube shape, and an outer shape of a transverse cross section formed as a flat circular shape. The tapered part 10*b* includes a front end where an opening 10*g* is formed with a flat circular shape in a cross section. In the tapered part 10*b*, one direction A (the vertical direction in FIG. 1) perpendicular to the axial direction is assumed to be a longer axis direction, and another direction B (the vertical direction in FIG. 2) perpendicular to the axial direction and the one direction is assumed to be a shorter axis direction. On the outer peripheral surface of the main body 10*a*, an O-ring groove that extends in a ring shape is disposed at the front side of the collar portion 10*d*. An O-ring R is engaged and mounted in the O-ring groove. The O-ring R functions as an annular elastic body that improves air tightness and fitting stability inside of a cap C1 described later.

The inner filling cylinder 11 is formed of a transparent material to have optical transparency that allows seeing the cosmetic material M through the filling region 1*x* inside. The inner filling cylinder 11 includes a main body 11*a* in a cylindrical shape, a tapered part 11*b*, and a front end 11*d*. The tapered part 11*b* connects to the front side of the main body 11*a*. The front end 11*d* connects to the front side of the tapered part 11*b* via a step.

The main body 11*a* includes a hole portion 11*e*. The hole portion 11*e* is a passage portion that allows discharging air and a part of the cosmetic material M inside of the filling region 1*x* out of the filling region 1*x*. A pair of hole portions 11*e* are formed in a position to face each other on the peripheral wall in the rear end portion of the main body 11*a*. The tapered part 11*b* has a tapered truncated-cone tube shape, and an outer shape of a transverse cross section formed as a flat circular shape. The front end 11*d* has an outer shape of a transverse cross section formed as a flat circular tube shape. In the tapered part 11*b* and the front end 11*d*, the one direction A is assumed to be a longer axis direction and the other direction B is assumed to be a shorter axis direction. The inner filling cylinder 11 is inward inserted and mounted to the outer filling cylinder 10. In the following description, the one direction A is referred to as a longer axis direction A and the other direction B is referred to as a shorter axis direction B.

FIG. 4 to FIGS. 7A and 7B are views each showing the leading end member in the cosmetic material applying container of FIG. 1. As shown in FIG. 4 to FIGS. 7A and 7B, the member 1 according to the present embodiment includes the leading end member 12 formed of a soft material to apply the cosmetic material M as described above. The soft material, for example, can employ a thermosetting general rubber that is heated and molded by a vulcanization, and a thermoplastic elastomer that is one kind of the plastic and is molded by plasticizing by heat and flowing into a metal mold.

The general rubber mainly employs a nitrile rubber (NBR), a butyl rubber (IIR), an ethylene propylene rubber (EPDM), and a silicon rubber (Si). Further, the thermoplastic elastomer mainly employs a polyester elastomer (TPEE), an olefin elastomer (TPO), and a urethane elastomer (TPU). Among them, the urethane elastomer can employ a polyurethane as a hard segment and any of two types of a polyester type and a polyether type as a soft segment. For the cosmetic material M, the urethane elastomer with the soft segment of the polyether type is especially suitable.

The leading end member 12 is preferred to be structured such that a hardness by a type A durometer defined by JIS K 6253 is set to 60±20. The leading end member 12 includes a sharp leading end (leading end portion) 13 at the distal end side and a base end 16 that connects to the base end side of the leading end 13 via a step 14.

The leading end 13 is formed in an outer shape of a transverse cross section in a flat circle and have an edge shape in a side view. Here, the leading end 13 is formed in a sharp shape where one side (an upper side in FIG. 4) of the transverse cross section in the longer axis direction A is sharpened at an acute angle viewed from the distal end side. The leading end 13 has a tapered shape where a length in the shorter axis direction B becomes shorter toward the distal end side. The leading end 13 includes a top end surface that constitutes an applying surface S. The applying surface S contacts an application target such as a skin and similar target of a user.

The applying surface S is a curved surface that extends straight in the shorter axis direction B of the transverse cross section of the leading end 13. The applying surface S includes a distal end where a vertex position P is formed. The applying surface S includes a concave part 81 at the distal end side. The concave part 81 is depressed toward the base end side in a side view (viewed in the shorter axis direction B). Further, the applying surface S includes a convex part 82 at a base end side of the concave part 81. The convex part 82 bulges toward the distal end side in a side view. Here, the concave part 81 and the convex part 82 smoothly connect to each other. Accordingly, the applying surface S has a curved surface shape that extends in an S-shape (also referred to as a sine curve shape, a shape of the third-order curve, or a wave shape) in a side view. In other words, in the case where a predetermined reference plane 85 passing through the vertex position P is set, the concave part 81 is formed to be depressed with respect to the reference plane 85. On the other hand, the convex part 82 is raised with respect to the reference plane 85.

That is, in a side view, the applying surface S is a curved surface that is inclined with respect to a direction of an axis line G from the vertex position P that constitutes a sharp portion of a distal end of the leading end 13 toward a base end side (a rear side), has a depressed shape depressed toward the base end side at a distal end side, and has a convex shape to bulge toward the distal end side after the depressed shape. At this time, an inclination angle (the gradient of the tangent line) of the applying surface S with respect to the direction of the axis line G gradually becomes larger from the vertex position P toward the base end side. This forms the concave part 81. Then, the inclination angle gradually becomes smaller, thus forming the convex part 82. The applying surface S has an elongated flat circular shape in a direction along the direction of the axis line G viewed from the longer axis direction A (see FIG. 5B). In other words, the applying surface S has an elongated surface shape back and forth.

On both side surfaces of the leading end 13, a tapered surface 17 is formed in a region from the outside edge of the applying surface S to the base end side by a predetermined length. The tapered surface 17 is inclined to the applying surface S side to have a tapered shape. At the position of the axis line G in the leading end 13, a through hole 18 is formed with an approximately circular shape in a cross section. The through hole 18 extends along the direction of the axis line G. The applying surface S in the through hole 18 includes an opening portion that constitutes a discharge port 18*a* for discharging the cosmetic material M.

Figure 5A:
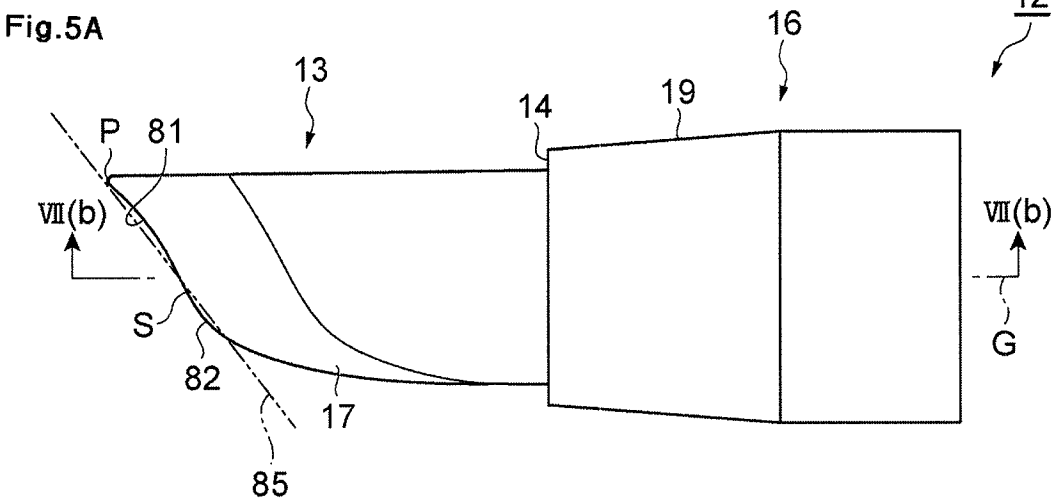
FIG. 5A is a side view of the leading end member in FIG. 4.
Figure 5B:
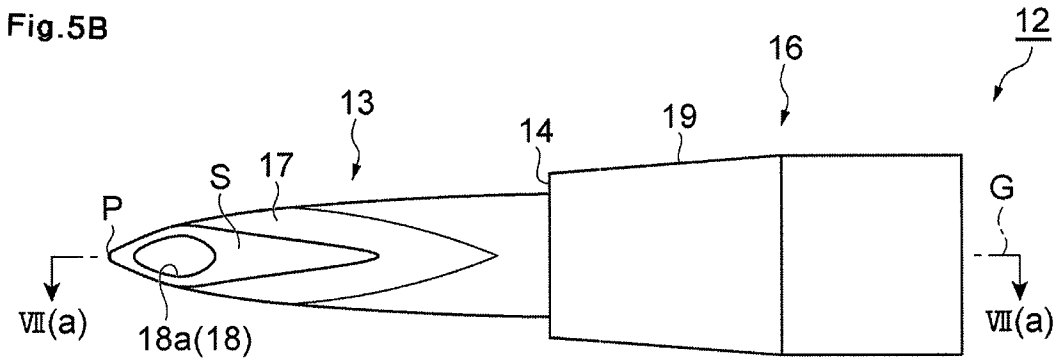
FIG. 5B is a bottom view of the leading end member in FIG. 4.
Figure 6A:
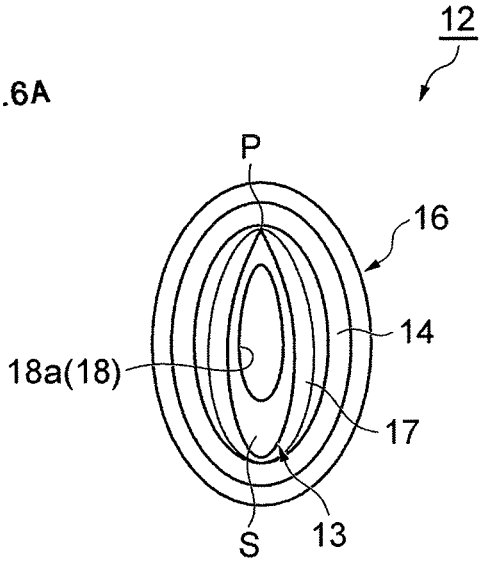
FIG. 6A is a front view of the leading end member in FIG. 4.
Figure 6B:
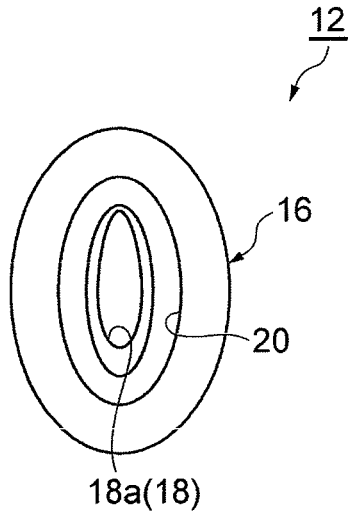
FIG. 6B is a back view of the leading end member in FIG. 4.
Figure 7A:
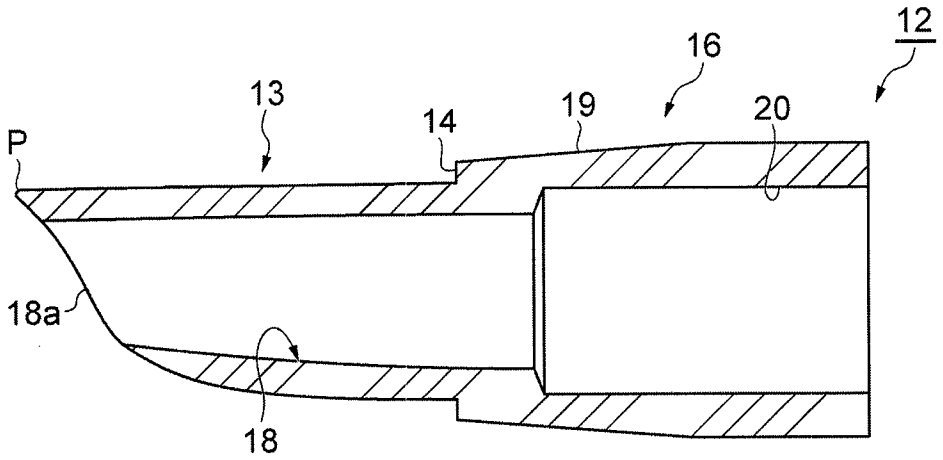
FIG. 7A is a cross sectional view along a line VII(a)-VII(a) in FIG. 5B.
Figure 7B:
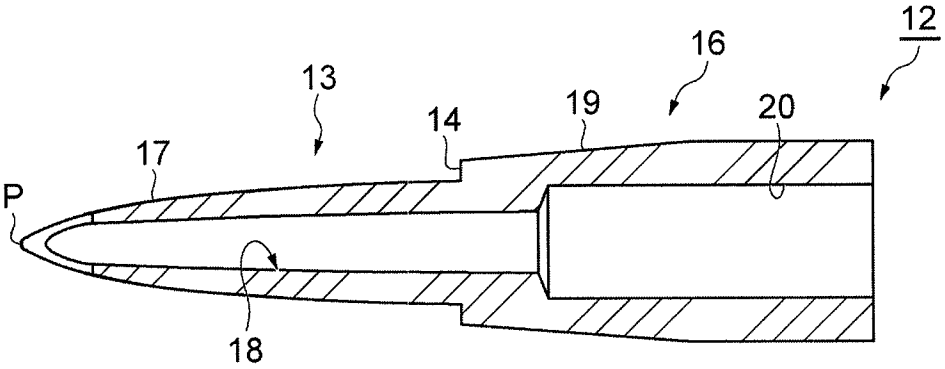
FIG. 7B is a cross sectional view along a line VII(b)-VII(b) in FIG. 5A.

The discharge port 18*a* is formed in the center position of the applying surface S viewed from the distal end side (the direction of the axis line G), and has a drop shape that bulges at the other side in the longer axis direction A (see FIG. 6A). The discharge port 18*a* has an approximately oval shape that is an ellipse shape at the front side viewed from the longer axis direction A (see FIG. 5B).

The base end 16 has a cylindrical shape, and has an outer shape of a transverse cross section in a flat circular shape with a larger diameter than that of the leading end 13. The base end 16 includes an outer peripheral surface where a tapered surface 19 is formed in a region from the front end to the center of the base end 16. The tapered surface 19 is inclined in a tapered shape to engage the tapered part 10*b* of the outer filling cylinder 10 (see FIG. 2). A tube hole 20 of the base end 16 is formed with a larger diameter than that of the through hole 18, and extends along the direction of the axis line G to communicate with the through hole 18.

As shown in FIGS. 1 to 7A and 7B, the leading end member 12 is mounted by inward inserting the leading end 13 to the opening 10*g* of the outer filling cylinder 10 so as to engage the outer filling cylinder 10 in the rotating direction. A tube hole 20 of the base end 16 is outward inserted to the front end 11*d* of the inner filling cylinder 11 so as to engage the inner filling cylinder 11 in the rotating direction and have a close contact with each other. At this time, in the leading end member 12, the step 14 engages a front end of the tapered part 10*b* of the outer filling cylinder 10 in the axial direction, and a rear end surface of the base end 16 engages a step 11*c* of the inner filling cylinder 11 in the axial direction. Accordingly, the leading end member 12 is sandwiched by the outer filling cylinder 10 and the inner filling cylinder 11 in the axial direction, and maintained.

In the filling member 1 that includes the outer filling cylinder 10, the inner filling cylinder 11, and the leading end member 12, the inner filling cylinder 11 is plugged at a distal end side to close. Then, the cosmetic material M is injected to the filling region 1*x* from a rear side. After detaching the plug, the inner filling cylinder 11 is assembled in the outer filling cylinder 10 where the leading end member 12 is mounted. This allows filling the inner filling cylinder 11 with the cosmetic material M.

The filling member 1 filled with the cosmetic material M is inward inserted to the main body cylinder 2 from the rear portion side of the filling member 1. Accordingly, the annular concave part 10*c* of the outer filling cylinder 10 engages the annular protrusion 2*b* of the main body cylinder 2, and the knurling 10*e* of the outer filling cylinder 10 engages the knurling 2*a* of the main body cylinder 2. Accordingly, the filling member 1 is engaged and mounted in the main body cylinder 2 in the axial direction and the rotating direction, and is integrated with the main body cylinder 2.

In addition, the piston 7 is inward inserted and mounted to the rear end portion of the inner filling cylinder 11 of the filling member 1 in airtight contact with each other. At this time, even in the case where air exists between the cosmetic material M and the piston 7 inside of the filling region 1*x*, the hole portion 11*e* disposed in the rear end portion of the inner filling cylinder 11 moderately discharges the air between these members through the hole portion 11*e* so as to reduce increase in internal pressure of the filling region 1*x*. Subsequently, the cap C1 is mounted from the distal end side of the filling member 1. Inside of the cap C1, an inner pipe C3 is disposed. The inner pipe C3 is outward inserted and mounted to the distal end side of the outer filling cylinder 10.

Next, a description will be given of a case (a method) of three-dimensionally forming a shape of the leading end 13 of the leading end member 12 described above. In this case, in the description here, a description will be given of an example where the tapered surface 17 is not formed in the leading end 13 as an embodiment.

FIGS. 8A and 8B and FIGS. 9A and 9B are views for explaining the three-dimensional formation of the shape of the leading end. In the present embodiment, it is preferred to use a surface type computer aided design (CAD) for three-dimensionally forming the shape of the leading end 13. For example, a rhinoceros (a software manufactured by Robert-McNeel & Associates) is used.

Figure 8A:
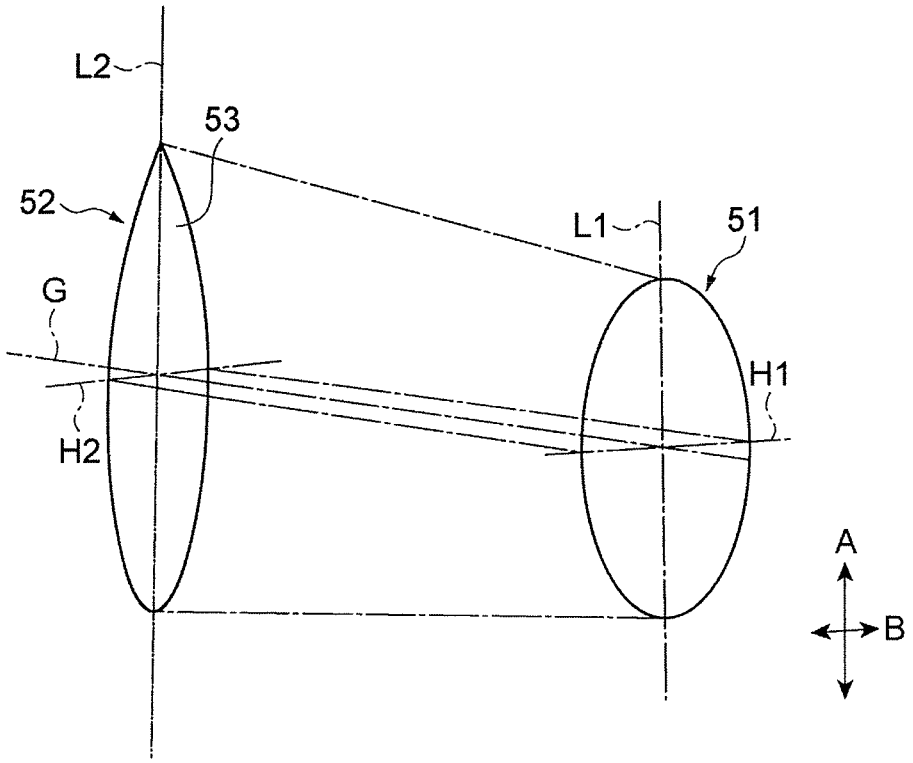
FIG. 8A is a view for explaining a three-dimensional shape of a leading end shape.

First, as shown in FIG. 8A, a flat base end shape 51 is drawn in a position corresponding to a base end (the right side in the drawing) in the direction of the axis line G of the leading end 13. The base end shape 51 has a longer axis L1 and a shorter axis H1, and has a shape obtained by deforming a circular shape flat toward the center. Subsequently, a flat distal end shape 52 is drawn in a position separated by a constant distance toward a distal end side (the left side in the drawing) with respect to the base end shape 51 in the direction of the axis line G. The distal end shape 52 is parallel to the base end shape 51, has a longer axis L2 and a shorter axis H2, and has a shape obtained by deforming a circular shape flat toward the center.

At this time, a direction of the longer axis L1 of the base end shape 51 and a direction of the longer axis L2 of the distal end shape 52 are set equal to each other, and set to the longer axis direction A here. A direction of the shorter axis H1 of the base end shape 51 and a direction of the shorter axis H2 of the distal end shape 52 are set equal to each other, and set to the shorter axis direction B here. The base end shape 51 and the distal end shape 52 have respective long diameters that are approximately equal to each other (respective lengths of the longer axes L1 and L2). On the other hand, a short diameter (a length of the shorter axis H2) of the distal end shape 52 is set shorter than a short diameter (a length of the shorter axis H1) of the base end shape 51. The distal end shape 52 includes a sharp portion 53 at one side of the longer axis direction A. The sharp portion 53 is formed as a corner portion that is sharpened at an acuter angle than that at the other side in the longer axis direction A. A constant separation distance between the base end shape 51 and the distal end shape 52 is set to a distance corresponding to a length of the leading end 13 in the direction of the axis line G.

Figure 8B:
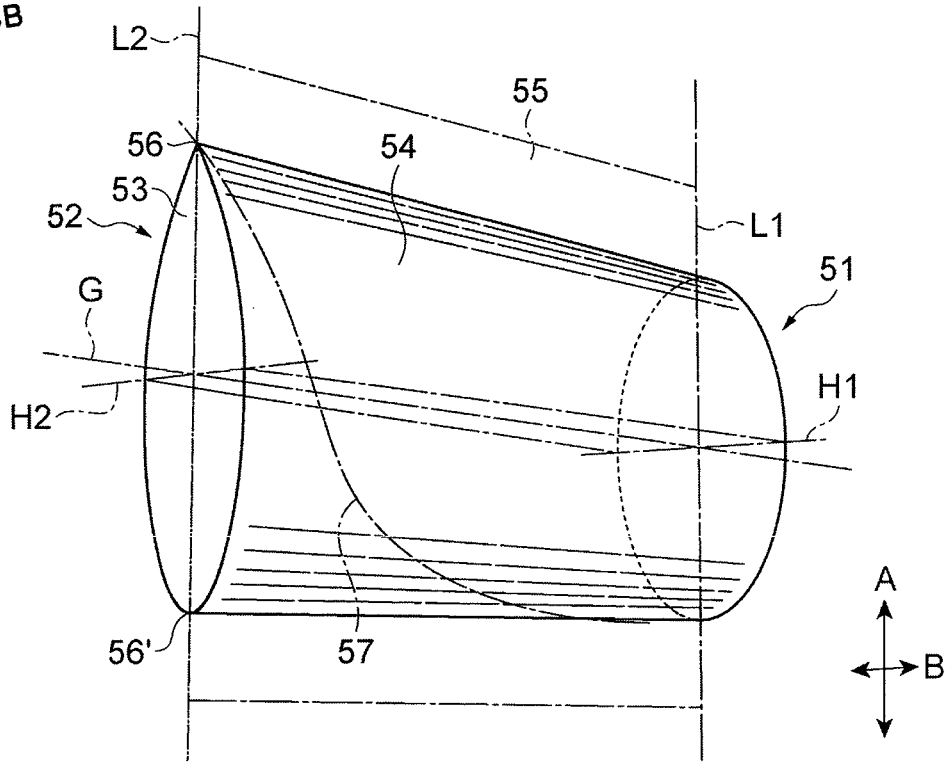
FIG. 8B is a view showing a subsequence of FIG. 8A.

Subsequently, as shown in FIG. 8B, the base end shape 51 and the distal end shape 52 constitutes a tapered flat circular column (flat column body) 54. The tapered flat circular column 54 has the base end shape 51 and the distal end shape 52 as end surfaces. The curved line 57 is set on the planar surface 55 that includes the longer axes L1 and L2. The curved line 57 is inclined from one intersecting point 56 between the outer edge of the distal end shape 52 and the longer axis L2 toward the base end side.

Specifically, the curved line 57 passes through the one intersecting point 56 where an end of the sharp portion 53 of the distal end shape 52 intersects the longer axis L2 on the planar surface 55. The curved line 57 is inclined toward the base end side, has, at the distal end side, a depressed shape depressed toward the base end side, and has a convex shape that bulges toward the distal end side after the depressed shape. The curved line 57 is drawn to pass through a side surface of the flat circular column 54 at the base end side. The curved line 57 here is drawn by an S-shaped free curve where the gradients of the tangent line changes gradually. A gradient (an inclined angle) between the tangent line of the free curve and the axis line G gradually becomes larger from the one intersecting point 56 along the base end side and then gradually becomes smaller.

Figure 9A:
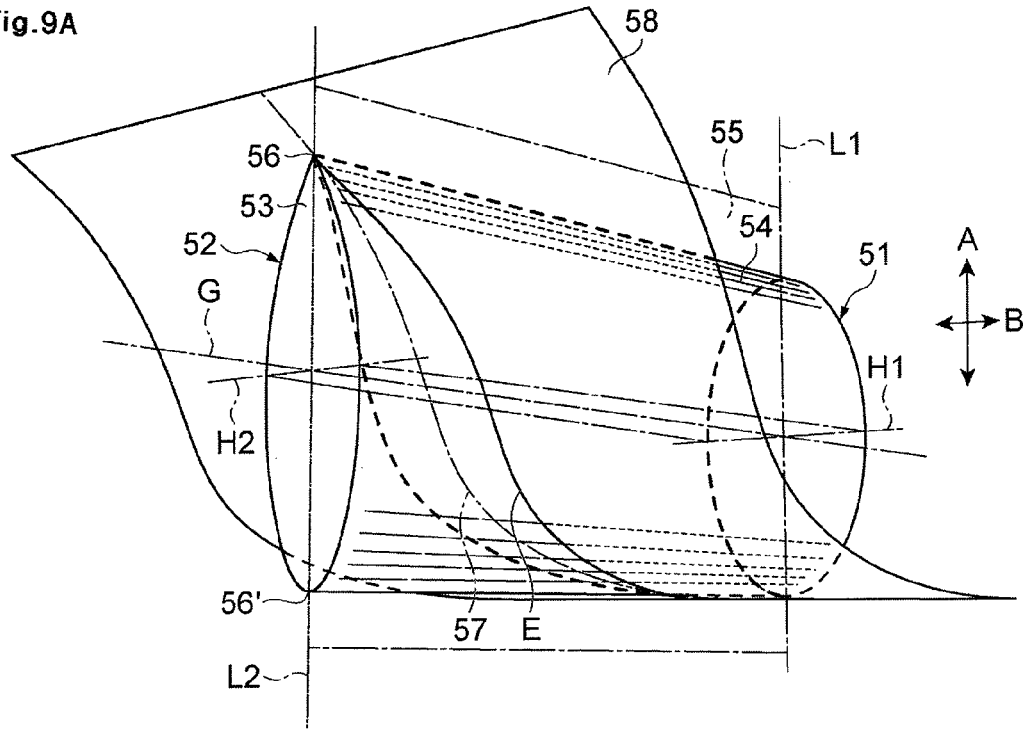
FIG. 9A is a view showing a subsequence of FIG. 8B.
Figure 9B:
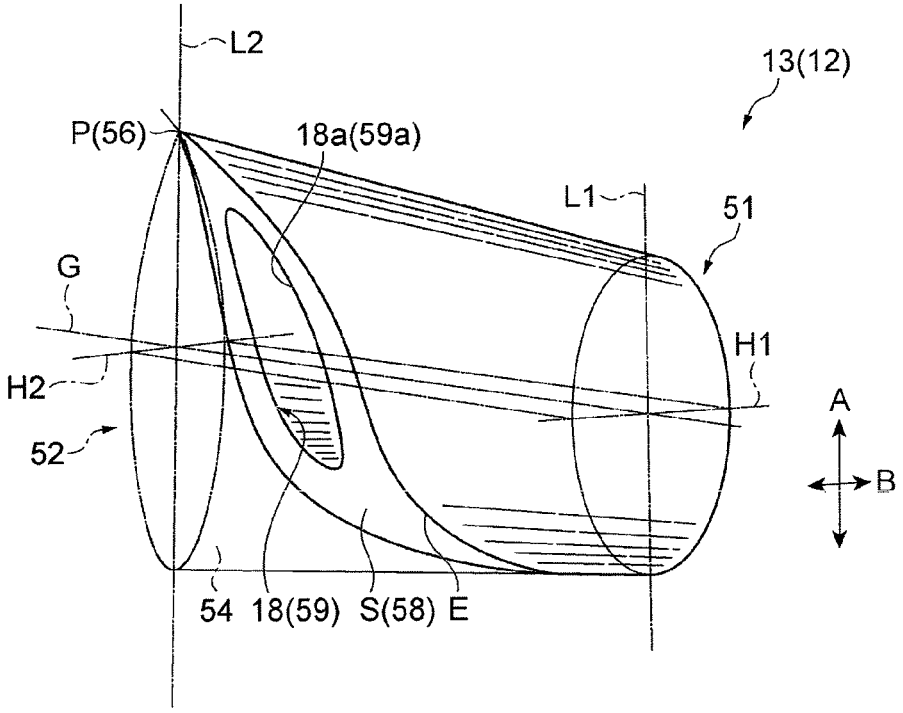
FIG. 9B is a view showing a subsequence of FIG. 9A.

Subsequently, as shown in FIG. 9A, the flat circular column 54 is cut by a cut surface 58 that passes through the curved line 57 and extends in the directions of the shorter axes H1 and H2. In other words, the flat circular column 54 is cut by the cut surface 58 formed by extending the curved line 57 to both one side and the other side in a side direction (a normal direction of the planar surface 55) with reference to the planar surface 55. Accordingly, an intersecting line between the flat circular column 54 and the cut surface 58 (that is, a visible outline of a surface where the flat circular column 54 intersects the cut surface 58) becomes a top end surface outer edge E. Furthermore, a portion that projects in the normal direction of the planar surface 55 with respect to the top end surface outer edge E of the cut surface 58 (a portion that does not intersect the flat circular column 54 of the cut surface 58 in FIG. 9A) is cut to form the applying surface S. As shown in FIG. 9B, a through hole 59 with a circular cross section is disposed along the direction of the axis line G to couple the center of the base end shape 51 and the center of the distal end shape 52 together. Accordingly, an opening 59*a* is disposed at the center of a top end surface of the flat circular column 54 cut by the cut surface 58 viewed from the direction of the axis line G.

As described above, the leading end 13 that has a flat circle outer shape in a transverse cross section and an edge shape in a side view is three-dimensionally formed. The top end surface of the flat circular column 54 cut by the cut surface 58 three-dimensionally forms the applying surface S (here, the applying surface S in an S-shape that includes the concave part 81 and the convex part 82) that includes the concave part 81 at least at the distal end side. Furthermore, the one intersecting point 56 three-dimensionally forms the vertex position P, and the opening 59*a* three-dimensionally forms the discharge port 18*a*.

In the cosmetic material applying container 100 constituted as described above in the initial state shown in FIG. 1, in the case where the user removes the cap C1 and a plug C2 and relatively rotate the main body cylinder 2 and the control cylinder 3 in one direction as a delivery direction, the thread engagement portion 9 formed by the female thread 4*e* of the screw cylinder 4 and the male thread 6*b* of the movable body 6 collaborate with the rotation preventing portion formed by the projection 3*d* of the control cylinder 3 and the projection 6*c* of the movable body 6. This allows forward movement of the movable body 6 and the piston 7.

As shown in FIG. 2, the forward movement of the movable body 6 and the piston 7 allows discharging the cosmetic material M filled in the filling region 1*x* or the filling member 1 from the discharge port 18*a* of the leading end member 12. In this state, the user presses the applying surface S of the leading end 13 to an application target such as an edge of the eye to draw a cosmetic material line.

Figure 10B:
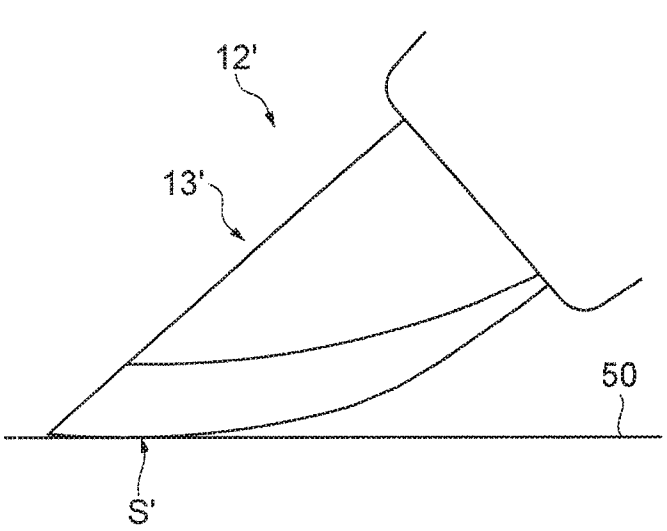
Fig.10B Prior Art
FIG. 10B is a view for explaining a conventional cosmetic material applying container.
Figure 10A:
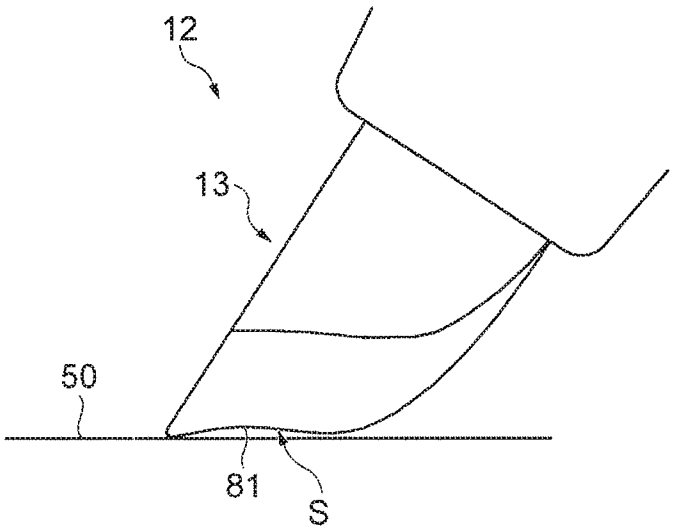
FIG. 10A is a view for explaining the cosmetic material applying container in FIG. 1.

Here, in the present embodiment, as described above, the distal end side of the applying surface S has the concave part 81 depressed toward the base end side in a side view. Accordingly, as shown in FIGS. 10A and 10B, the leading end 13 reduces contact between the applying surface S and a skin 50 as the application target compared with a conventional leading end 13' that includes an applying surface S' without the concave part 81. As a result, this reduces contact feeling by the applying surface S so as to obtain comfortable use feeling. In the applying surface S, the concave part 81 reduces contact with the skin 50. Accordingly, the cosmetic material M discharged from the discharge port 18*a* does not expand in a side direction. This allows appropriately drawing a narrow line compared with the conventional applying surface S'.

Figure 11B:
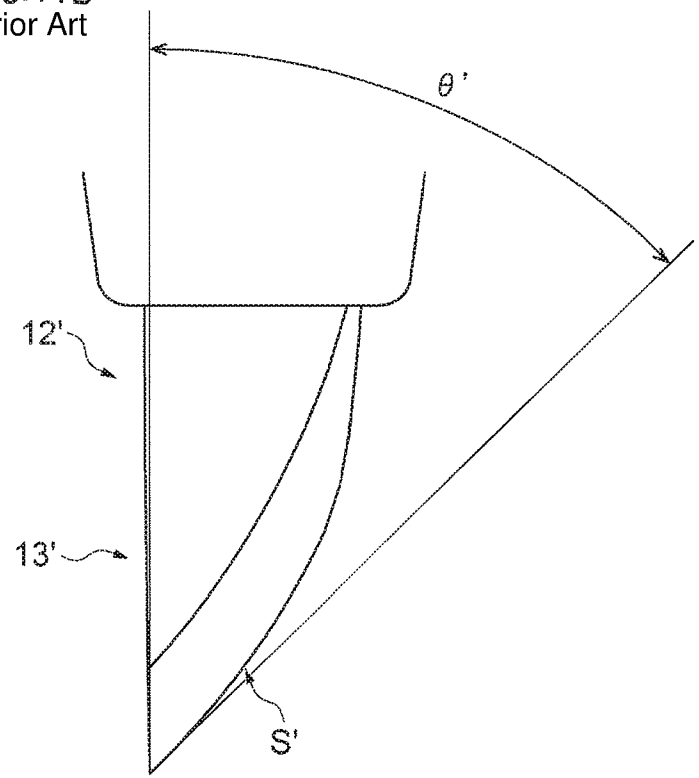
Fig.11B Prior Art
FIG. 11B is another view for explaining the conventional cosmetic material applying container.
Figure 11A:
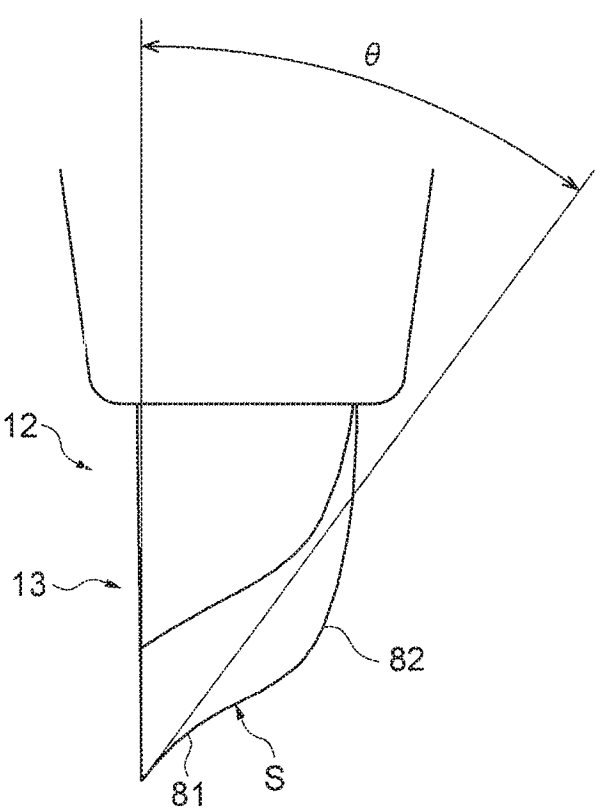
FIG. 11A is another view for explaining the cosmetic material applying container in FIG. 1.

In addition, the concave part 81 ensures a thin distal end side of the leading end 13. As shown in FIGS. 11A and 11B, a point angle θ of the leading end 13 is acuter than a point angle θ' of the conventional leading end 13'. As a result, this facilitates drawing a narrow line. Accordingly, the thin distal end side of the leading end 13 ensures a flexible (soft) distal end side with good contact feeling, that is, adds flexibility to the distal end side, thus further ensuring comfortable use feeling. Therefore, the cosmetic material applying container 100 according to the present embodiment ensures comfortable use feeling and facilitates drawing a narrow line.

Figure 12B:
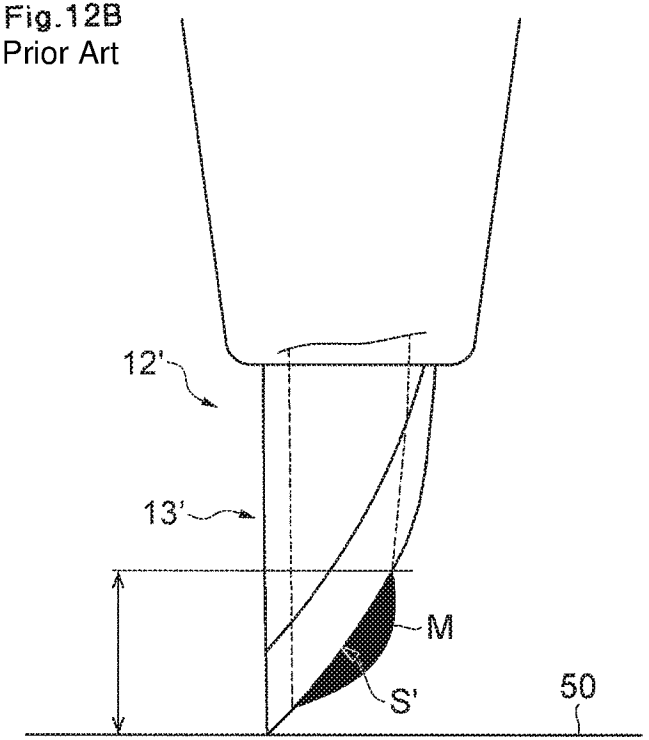
Fig.12B Prior Art
FIG. 12B is another view for explaining the conventional cosmetic material applying container.
Figure 12A:
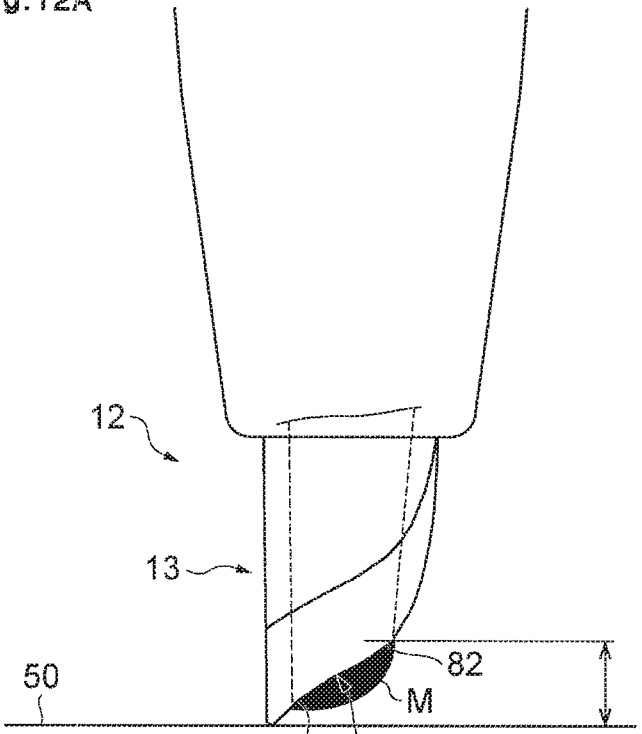
FIG. 12A is another view for explaining the cosmetic material applying container in FIG. 1.
Figure 13B:
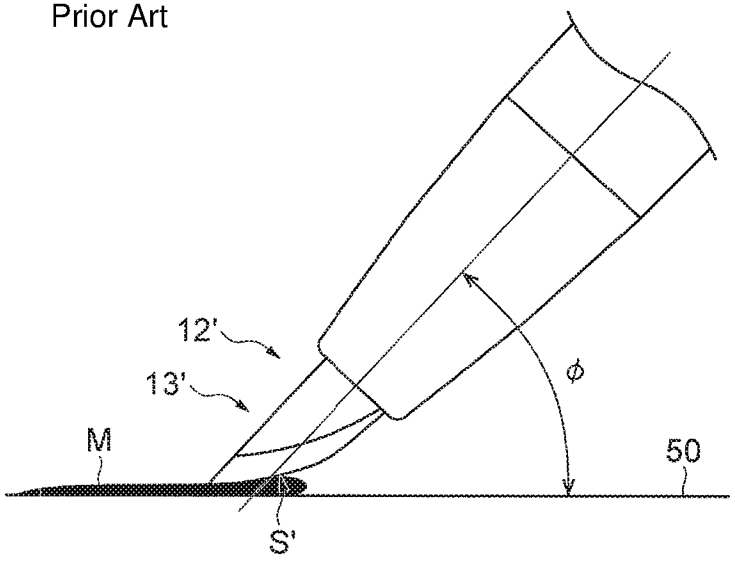
Fig.13B Prior Art
FIG. 13B is a view showing an example of use of the conventional cosmetic material applying container.
Figure 13A:
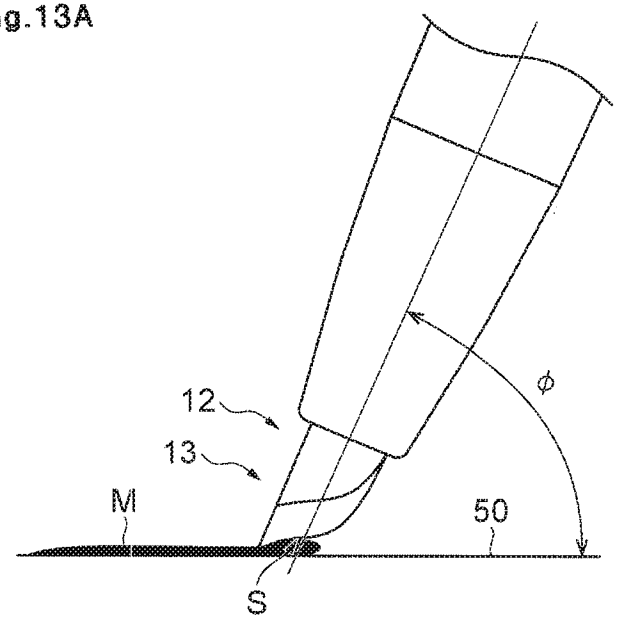
FIG. 13A is a view showing an example of use of the cosmetic material applying container in FIG. 1.

The applying surface S according to the present embodiment includes the convex part 82 that bulges toward the distal end side in a side view at the base end side of the concave part 81 as described above. In this case, as shown in FIGS. 12A and 12B, cosmetic material M is discharged from the more distal end side of the leading end 13 compared with the conventional leading end 13'. As a result, as shown in FIGS. 13A and 13B, the cosmetic material applying container 100 is easily used in an upright position on the skin 50 compared with the cosmetic material applying container 100' that includes the conventional leading end 13'. That is, a use angle ϕ with respect to the skin 50 in the leading end 13 is allowed to be a larger angle than a use angle ϕ' in the conventional leading end 13'.

Accordingly, for example, in the case where both right and left eye lines are drawn, this allows appropriately managing a situation where it is difficult to draw an eye line at the opposite side of the dominant hand side using the dominant hand in a lying state. As a result, this allows appropriately drawing right and left eye lines (especially, an eye line at the opposite side of the dominant hand).

The applying surface S according to the present embodiment has the curved surface shape where the concave part 81 and the convex part 82 smoothly connect to each other and extends in an S-shape in a side view as described above. This configuration appropriately ensures all of the operation and effect that ensure comfortable use feeling, the operation and effect that facilitate drawing a narrow line, and the operation and effect that facilitate using the cosmetic material applying container 100 in an upright position.

As described above, the shape of the leading end 13 according to the present embodiment is three-dimensionally formed by setting the curved line 57 that has the depressed shape and the convex shape while being inclined from the one intersecting point 56 toward the base end side on the planar surface 55 of the column body 54 and by cutting the column body 54 with the cut surface 58 passing through the curved line 57. This allows appropriately three-dimensionally forming the applying surface S that has the concave part 81 and the convex part 82.

The present embodiment also provides the following operations and effects.

That is, when the main body cylinder 2 and the control cylinder 3 relatively rotate in one direction, an elastic force of the spring portion 5*b* of the ratchet member 5 biases the ratchet teeth 8*b* to the front side in the axial direction. Engagement and engagement release (meshing and meshing release) of the ratchet teeth 8*a* and 8*b* in the ratchet mechanism 8 are repeated. That is, the side surfaces of the ratchet teeth 8*a* engage the side surfaces of the ratchet teeth 8*b* in the rotating direction. The ratchet teeth 8*a* slide upon the side surfaces of the ratchet teeth 8*b* to rise rapidly. After the ratchet teeth 8*a* go beyond the ratchet teeth 8*b* to release the engagement, these side surfaces engage with each other again in the rotating direction. As a result, this provides click feeling to the user for each engagement and engagement release of the ratchet teeth 8*a* and 8*b*. Here, one click feeling is provided when one-eighth relative rotation (45°) between the main body cylinder 2 and the control cylinder 3 is provided in one direction.

On the other hand, even if relative rotation between the main body cylinder 2 and the control cylinder 3 are attempted in the other direction that is a returning direction, the side surfaces of the ratchet teeth 8*a* are brought into contact with the side surfaces of the ratchet teeth 8*b* and locked in the rotating direction to restrict the relative rotation so as not to relatively rotate the screw cylinder 4 and the ratchet member 5. As a result, the main body cylinder 2 and the control cylinder 3 do not rotate relatively in the other direction. In the present embodiment, the ratchet mechanism 8 restricts relative rotation between the main body cylinder 2 and the control cylinder 3 in the other direction but allows relative rotation between the main body cylinder 2 and the control cylinder 3 only in one direction.

In the present embodiment, the color of the leading end 13 is different from the color of the cosmetic material M. This facilitates visually recognizing the usage condition of the cosmetic material M. In the case where the leading end 13 warps in the longer axis direction A, the discharge port 18*a* is compressed and deformed in the shorter axis direction B. The compressed and deformed discharge port 18*a* discharges the cosmetic material M little by little. This allows drawing a narrow and long cosmetic material line without running short of a liquid (skipping) when the cosmetic material M is applied over the skin 50.

As described above, a portion corresponding to the one intersecting point 56 in the distal end shape 52 is formed as the sharp portion 53 that is a corner portion sharpened at an acute angle when the leading end 13 is three-dimensionally formed, and is shaper than a portion corresponding to the other intersecting point 56' (see FIGS. 8A and 8B) between the outer edge of the distal end shape 52 and the longer axis L2. This allows three-dimensionally forming an acute distal end side of the applying surface S so as to form the vertex position P on the applying surface S. As a result, this especially facilitates drawing a narrow cosmetic material line. Rounding the vertex position P as a small sphere-shaped vertex position (the vertex position P with a small radius (R) of a spherical surface) allows adjustment for softening the contact with the skin 50 as the application target portion.

As described above, when the leading end 13 is three-dimensionally formed, the length of the shorter axis H2 is shorter than the length of the shorter axis H1 and the flat circular column 54 has a tapered shape. This allows three-dimensionally forming the shape of the leading end 13 in a tapered shape. This further facilitates drawing a cosmetic material line.

As described above, the applying surface S three-dimensionally formed by cutting the flat circular column 54 with the cut surface 58 has an elongated flat circular shape that has a longitudinal direction in a direction along the direction of the axis line G viewed from the longer axis direction A. The vertex position P is formed at the distal end of the applying surface S. This further facilitates drawing a narrow cosmetic material line.

As described above, the leading end 13 according to the present embodiment has the tapered surfaces 17 on both side surfaces. As shown in FIG. 5B, the leading end 13 is not tapered at a constant inclination angle in the shorter axis direction B, but is tapered especially at the distal end side. As a result, this maintains a thickness of the leading end 13 at the base end side, thus improving rigidity of the leading end 13.

The description has been given above of the embodiment according to the present invention, however, the present invention is not limited to the embodiment mentioned above, and may be modified within a range which does not change the scope described in each of claims, or may be applied to the other structures.

For example, the applying surface S of the embodiment above includes the concave part 81 and the convex part 82, but may have the concave part 81 only. The applying surface S has an S-shape where the concave part 81 and the convex part 82 are continuously formed in a side view, but may have a shape where the concave part 81 and the convex part 82 are intermittently formed.

While in the embodiment above the vertex position P is three-dimensionally formed at the distal end of the applying surface S of the leading end 13 by forming the sharp portion 53 in the distal end shape 52, this should not be construed in a limiting sense. The vertex position P may be formed at the distal end of the applying surface S by after processing.

While in the embodiment above the cut surface 58 (see FIGS. 9A and 9B) is the surface formed by extending the curved line 57 to both sides of the side direction when the leading end 13 is three-dimensionally formed, this should not be construed in a limiting sense. The cut surface 58 may be any surface passing through the curved line 57. For example, the cut surface 58 may be a surface that bulges toward the distal end side in a curved surface with the curved line 57 as a peak portion. In this case, the applying surface S of the leading end 13 is three-dimensionally formed in a shape that bulges toward the distal end side in a curved surface with a portion corresponding to the curved line 57 as a peak portion. As another example, the cut surface 58 may be a surface that is depressed toward the base end side in a curved surface with the curved line 57 as a ship bottom. In this case, the applying surface S of the leading end 13 is three-dimensionally formed in a shape that is depressed toward the base end side in a curved surface with a portion corresponding to the curved line 57 as a ship bottom.

While in the embodiment above the main body cylinder 2 (a container front portion) and the control cylinder 3 (a container rear portion) form a container that relatively rotates to move the movable body 6 and the piston 7, the container may move the movable body 6 and the piston 7 by a knock mechanism. Instead of or in addition to forward movement of the movable body 6 and the piston 7 to extrude the cosmetic material M, rearward movement of the movable body 6 and the piston 7 may pull back the cosmetic material M (rearward movement). The container may include an inner cotton impregnated with the cosmetic material M inside of the filling member 1, and the cosmetic material M may be discharged from the discharge port 18*a* of the leading end 13 using a capillary phenomenon by a relay core. Further, the container may discharge the cosmetic material M from the leading end 13 using a capillary phenomenon with a bellows-like regulating mechanism.

While the curved line 57 (see FIGS. 8A and 8B) set when the leading end 13 is three-dimensionally formed is drawn to pass through the base end side of the side surface of the flat circular column 54 on the planar surface 55, this should not be construed in a limiting sense. The curved line 57 may have various loci insofar as the curved line 57 is inclined from the one intersecting point 56 toward the base end side and includes, at the distal end side, a depressed shape depressed toward the base end side.

The present invention is, of course applicable to a cosmetic material applying container using the cosmetic material M, for example, a lip stick, a beauty essence, a cleaning fluid, a nail enamel, a nail care solution, a nail remover, a mascara, an anti-aging material, a cosmetic material for hair, an oral care material, a massaging oil, a keratotic plug removing fluid, a foundation, a skin cream, an ink for a writing instrument such as a marking pen, a liquid drug, and a slurry material.

The male thread and the female thread mentioned above may be constructed by any means which serves the same function as a thread ridge and a thread groove such as a projection group arranged intermittently, or a projection group arranged spirally and intermittently, in addition to the thread ridge and the thread groove. While in the embodiment above the spring portion 5*b* is integrated with the ratchet member 5, the spring portion 5*b* may be disposed separately from the ratchet member 5. In the above description, the ratchet mechanism 8 doubles as a click mechanism. The ratchet teeth 8*a* and 8*b* correspond to a pair of click projections (click teeth). While in the embodiment above the ratchet teeth 8*a* and 8*b* set to have the number of clicks that provides eight click feelings during one relative rotation between the container front portion and the container rear portion, the number of clicks may be increased to another number of clicks that provides 12 or 18 click feelings during one relative rotation to discharge the cosmetic material M more finely.

In the embodiment above the term "flat" is based on the flat circular shape such as the oval, the ellipse or the like where the circle is deformed flat (flattened), and the distal end shape 52 is formed as the drop shape having the sharp portion where the oval is changed. However, the flat shape according to the present invention can be selected as an elongated oval leaf shape, an elongated shape like a cats-eye, and an approximately polygonal shape such as an approximately triangular shape, an approximately pentagonal shape, and an approximately hexagonal, where the flat circular shape is further changed.

What is claimed is:

1. A cosmetic material applying container comprising:

a leading end portion for discharging a cosmetic material filled in a filling region inside of the container, the leading end portion being formed of a soft material, wherein the leading end portion is formed as an edge shape in a side view along a shorter axis direction while an outer shape of a transverse cross section is formed as a flat shape, a top end surface of the leading end portion constituting an applying surface, the leading end portion having a tapered shape with a shorter length of the shorter axis toward a distal end side, the distal end side of the leading end portion is formed in a sharp shape where one side in a longer axis direction is sharpened at an acute angle viewed from the distal end side, and the applying surface includes:

a distal end where a vertex position is formed, the vertex position constituting a sharp portion of the distal end of the leading end portion;

a concave part at the distal end side, the concave part being depressed toward a base end side in the side view;

a convex part at the base end side of the concave part, the convex part bulging toward the distal end side in the side view;

a curved surface shape that extends in an S-shape in the side view by smoothly connecting the concave part and the convex part to each other; and a discharge port for discharging cosmetic material that is provided continuously over the concave part and the convex part.

2. The cosmetic material applying container according to claim 1, wherein the shape of the leading end portion is three-dimensionally formed by:

constituting a flat column body by a flat base end shape and a flat distal end shape, the distal end shape being disposed at a distal end side with respect to the base end shape;

setting a curved line on a planar surface that includes a longer axis of the base end shape and a longer axis of the distal end shape in the column body, the curved line being inclined from one intersecting point between an outer edge of the distal end shape and the longer axis of the distal end shape toward the base end side, the curved line having a depressed shape at the distal end side, the depressed shape being depressed toward the base end side; and cutting the column body with a cut surface passing through the curved line.

* * * * *